US009351079B2

(12) United States Patent
Goller

(10) Patent No.: US 9,351,079 B2
(45) Date of Patent: May 24, 2016

(54) FLAT SUBWOOFER

(76) Inventor: Lars Goller, Herning (DK)

( * ) Notice: Subject to any disclaimer, the term of this patent is extended or adjusted under 35 U.S.C. 154(b) by 667 days.

(21) Appl. No.: 12/670,216

(22) PCT Filed: Jul. 25, 2008

(86) PCT No.: PCT/DK2008/000279
§ 371 (c)(1),
(2), (4) Date: Jan. 14, 2011

(87) PCT Pub. No.: WO2009/012782
PCT Pub. Date: Jan. 29, 2009

(65) Prior Publication Data

US 2012/0002838 A1 Jan. 5, 2012

(30) Foreign Application Priority Data

Jul. 25, 2007 (DK) ..... 2007 01093
Dec. 4, 2007 (DK) ..... 2007 01738

(51) Int. Cl.
*H04R 7/04* (2006.01)
*H04R 7/12* (2006.01)

(52) U.S. Cl.
CPC ..... *H04R 7/122* (2013.01); *H04R 2201/021* (2013.01); *H04R 2499/13* (2013.01)

(58) Field of Classification Search
CPC .... H04R 9/00; H04R 29/003; H04R 2209/00; H04R 2209/41; H04R 9/025; H04R 9/027; H04R 7/00; H04R 2207/00; H04R 7/06; H04R 7/04
USPC ..... 381/396, 398, 400, 404, 412, 433, 381/423–424, 431
See application file for complete search history.

(56) References Cited

U.S. PATENT DOCUMENTS

| | | | | |
|---|---|---|---|---|
| 5,143,169 | A | 9/1992 | Ziegenberg et al. | |
| 7,324,659 | B2 * | 1/2008 | Funahashi et al. | 381/398 |
| 7,515,728 | B2 * | 4/2009 | Kobayashi et al. | 381/398 |
| 8,111,868 | B2 * | 2/2012 | Kaiya | 381/396 |
| 2002/0067842 | A1 | 6/2002 | Takahashi | |
| 2005/0141746 | A1 | 6/2005 | Kobayashi | |
| 2007/0189571 | A1 * | 8/2007 | Corynew | 381/396 |

FOREIGN PATENT DOCUMENTS

WO 2005015950 2/2005

OTHER PUBLICATIONS

International Search Report, dated Oct. 24, 2008, received in the international patent application No. PCT/DK2008/000279, 3 pgs; International Written Opinion, dated Jan. 25, 2010, received in the international patent application No. PCT/DK2008/000279, 6 pgs.

* cited by examiner

*Primary Examiner* — Suhan Ni
(74) *Attorney, Agent, or Firm* — Michael P. Kochka, Esq.

(57) ABSTRACT

A flat subwoofer is provided comprising a driver in which a coil is arranged in an air gap in the driver, which coil is connected to a membrane, where the driver is arranged on a chassis, wherein the membrane comprises two interconnected parts, a forward membrane part and rear membrane part, where both membrane parts are substantially symmetrical around an axis perpendicular to the membranes plane, where each membrane part has an outer and an inner periphery where the forward membrane part along an outer periphery is connected to the chassis by a surround, and where the rear membrane part is connected to a spring member which spring member at least partly surrounds the driver.

3 Claims, 2 Drawing Sheets

DETAIL B
SCALE 2 : 1
20-35°
25-45°
DETAIL D
SCALE 2 : 1
15-35°
DETAIL C
SCALE 2 : 1
15-30°
Rxx
Ryy
Rzz
A
B
C
D

FLAT SUBWOOFER

BACKGROUND

1. Field of the Invention

The present invention relates to a flat subwoofer of the type where typically a coil is arranged in an air gap, provided in a magnetic field, such that when the direction of the current through the coil changes direction, the magnetic field causes the coil to move back and forth in the air gap. By further connecting the coil to a membrane, the membrane will move back and forth, thereby generate airwaves which we perceive as sound.

Several loudspeakers are known in the art which are particularly designed to emit sounds having a relatively low frequency, the so-called bass sounds. The creation of this type of loud speakers normally requires a relatively large membrane in order to be able to provide a desired sound pressure which in turn requires that the membrane has a certain strength and stability in order not to wobble, float or deform during use. In order to address this it has traditionally been the custom to use membranes having a funnel or cone shape in that the movement back and forth of the membrane could be strengthened by the funnel shape of the membrane.

2. Description of the Related Art

For a number of applications it is desirable to minimize the extent of the construction along the axis along which the sound is emitted. In order to provide for the relatively flat constructions flat membrane parts have been used. The size of the membrane however creates a number of problems in that in order to provide a sufficient sound pressure the coil in the air gap is brought to move a relatively long distance which again, when a relatively flat and thereby unstable membrane is used, creates distortion, deformation and excessive load on the membrane, such that the design usually is a compromise between size of the unit and the quality of the sound emitted, in relation to the sound pressure which must be achieved.

From WO 2005/015950 is known a membrane construction where the membrane is kept relatively flat and stiff by means of folding the membrane material in a determined pattern. The folds will however distribute the emitted sound in a more diffuse manner, manner, such that the resulting sound impression, due to the distortion created by the membrane, will be a compromise between quality and constructional features of the loudspeaker.

Yet another example is known from US 2004188175 wherein a flat subwoofer membrane construction is disclosed, where the membrane is constructed of two connected parts. Each part is provided with a separate surround connecting the membrane part to the chassis in order to guide the membrane's movement which centrally is connected to a cylinder around which the voice coil is provided. In order to avoid wobbling of the voice coil in the air gap between the magnets and the pole pieces the two surrounds maintain the membrane in a very rigid position such that the amount of wobble of the cylinder and thereby the voice coil in the air gap is minimized. This construction, however, creates a number of problems, but mainly a relatively high effect loss is realised due to the fact that two separate surrounds are provided which need to be moved in order for the membrane to move whereby a relative, effective dampening of the membrane is achieved resulting in an overall power loss. Furthermore, wave propagation in the membrane will the cause the surrounds to act out of synchronization whereby wobbling of the cylinder and thereby the voice coil in the air gap will be the result which again will provide undesired sound emitting properties.

SUMMARY

It is therefore an object of the present invention to provide a subwoofer construction being a flat type subwoofer where a high sound pressure may be achieved with a minimum of distortion.

The invention for this purpose provides a flat subwoofer comprising a driver in which a coil is arranged in an air gap, which coil is connected to a membrane, where said driver is arranged on a chassis, characterised in that the membrane comprises two interconnected parts, a forward membrane part and rear membrane part, where both membrane parts are substantially symmetrical around an axis perpendicular to the membranes plane; where said forward membrane part along an outer periphery is connected to the chassis by means of a surround, and where said rear membrane part has a general V-shaped cross section, where the two free ends of the V are connected to the forward membrane part, and the bottom of the V is connected to a spring member at least partly surrounding the driver, and where the coil is arranged on a coil cylinder, which cylinder which cylinder is connected either to the inner most free end of the rear membrane part or to the forward membrane part, or to the connection between the forward membrane part and the rear membrane part.

By splitting the membrane in two parts, a forward membrane part and a rear membrane part, it is possible to create a relatively flat forward membrane part which is strengthened by the shape of the rear membrane part. The rear membrane part is substantially V or U shaped, meaning that it has two free ends which are attached to the forward membrane part at distinct locations and a bottom part between the two free end parts which bottom part is attached to the chassis or via a spring member to the chassis. Whether or not the rear membrane part is one single piece or separate pieces or whether the rear membrane part is in the shape of V or a U or a different shape, does not influence the functioning of the part as long as it is attached to the forward membrane part and to the chassis or spring member as discussed above.

The rear membrane part in this manner helps to stabilize the forward membrane part such that as the coil moves in the air gap and thereby moves the forward membrane part, the relatively flat forward membrane part will be stabilized by the rear membrane part whereby an increased sound pressure may be generated without distortion in that the forward membrane part is stabilized due to the provision of the rear membrane part.

By further connecting the coil and in particular the coil cylinder in the same point as the inner most part of the rear membrane part connects to the forward membrane part or immediately adjacent this point, a very stiff connection is created between the coil or the coil cylinder and the membrane construction as such. This provides for a very stable transmission of vibrations from the coil to the membrane and thereby for an improved sound reproduction. When the rear most part of the rear membrane member is connected to a spring member the movability/flexibility of the entire membrane construction is further improved and at the same time stabilized in that the spring member will in addition to stabilize the forward membrane part also stabilize the coils' position in the air gap and thereby help to maintain a steady and stable high sound pressure with a minimum of distortion.

An almost fixed relative position of the coil, relative to the air gap, may also provide the possibility to narrow the air gap, and thereby increase the force of the magnetic field in the gap, and thereby the power of the driver.

In a further advantageous embodiment of the invention the spring member is arranged behind the air gap. In this configuration the rear membrane is provided with a larger extent along the axis of symmetry perpendicular to the plane of the front membrane whereby a further stabilizing of the membrane due to the increased moment of resistance provided by the increased V-shape, i.e. a "higher V", of the rear membrane whereby even more sound pressure and thereby better sound quality at higher sound pressures is achieved.

This construction also provides for a subwoofer having a wider range of frequencies within which to operate without distortion such that, due to the increased stability and strength of the system, it is possible to operate a subwoofer according to the inventive construction inside a wider frequency range.

In a still further advantageous embodiment of the invention the rear membrane part and/or the coil cylinder is provided with cut-outs. The cut-outs provides two distinguished advantages in that first of all the weight of the system may be reduced such that the weight that needs to be moved back and forth, i.e. accelerated due to the action of the coil in the air gap is reduced which in turn provides for a more rapid response time and less distortion due to the resistance in accelerating the mass of the membrane and coil back and forth. Furthermore the apertures provide less air resistance such that the build up of air pressure inside the construction will not be able to influence the movement of the membrane to the same degree had the cut-outs not been made.

The present invention is constructed by having a chassis which substantially encloses the rear of the subwoofer construction where as the front is delimited by the forward membrane fastened to the chassis by means of a surround which typically will create a substantially uninterrupted front surface.

Therefore in a further advantageous embodiment of the invention a ventilation aperture is provided substantially central in the driver, where said aperture connects the interior of the subwoofer behind the forward membrane and the chassis with the volume outside the subwoofer.

The ventilation aperture is provided in order to be able to equalize the air pressure inside and outside the subwoofer such that no air pressure will influence the movement of the membranes whereby a sound reproduction as close to the intended sound reproduction may be provided. The ventilation aperture in connection with the cut-outs provided in the rear membrane and the voice coil provides for a minimum of air resistance to the movement of the forward membrane which generates the sound.

The chassis may in a further advantageous embodiment be made from a cast metal or a plastic where the chassis substantially encloses the rear side of the subwoofer. In a number of applications, for example when the subwoofer is to be build into walls, corridors, and the like, it is important to seal the rear part of the subwoofer construction in that for example in cars the detrimental vibrations, air pressures, and the like may build up in for example a corridor which could influence the activity of the subwoofer as such. By substantially enclosing the subwoofer construction and only allowing the ventilation aperture to have access to the surroundings a controlled access to the air spaces inside the subwoofer construction is provided whereby the performance of the subwoofer may better be controlled.

BRIEF DESCRIPTION OF THE DRAWINGS

The invention will now be described with reference to a particular embodiment as depicted in the drawings.

DETAILED DESCRIPTION

Figure 1:
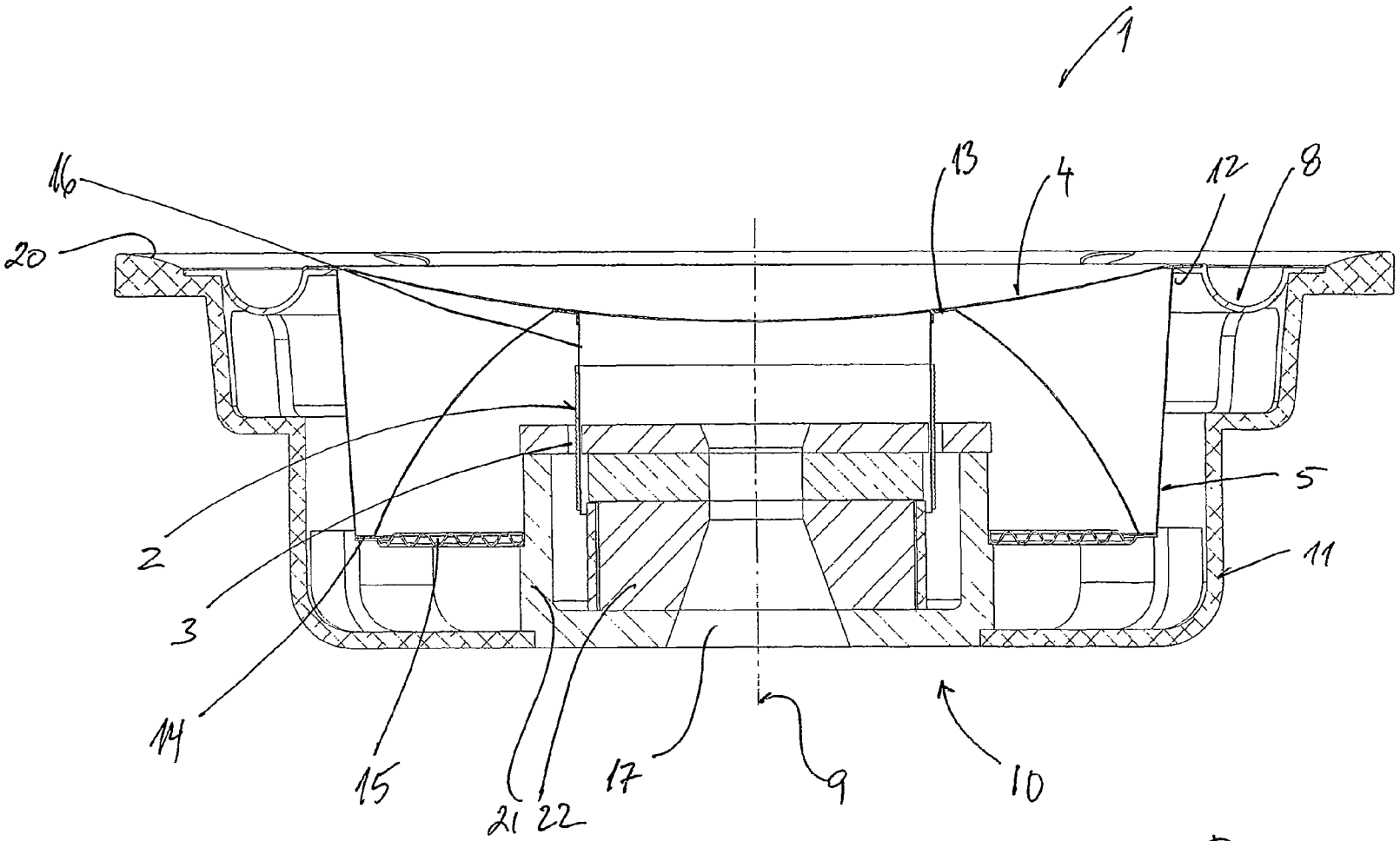
In FIG. 1 is illustrated a cross-section through a first embodiment of a subwoofer according to the present invention.

In FIG. 1 is illustrated a flat subwoofer according to the present invention. The subwoofer 1 comprises a chassis 11 substantially surrounding the rear of the subwoofer. The front of the subwoofer 1 is delimited by the forward membrane part 4 and the surround 8 as well as the rim of the chassis 2. When the subwoofer is mounted in use, this is the surface which a listener may be able to see. The rear of the subwoofer is in this embodiment enclosed by the chassis 11 part of the driver unit 10 and ventilation aperture 17.

In this embodiment the cross section of the subwoofer as illustrated in FIG. 1 is symmetrical about an axis of symmetry 9 perpendicular to the plane of the front of the subwoofer.

The driver, i.e. the motor of the loudspeaker is a traditional overhung coil construction where a magnetic system 21, 22 creates a magnetic flux in an air gap 3. Furthermore in the air gap a coil 2 is arranged on a coil cylinder 16 such that as an amplifier changes the direction of the current in the coil 2 the magnetic flux in the air gap 3 will influence the coil and thereby the coil cylinder to move up and down parallel to the axis of symmetry 9. As the cylinder 16 is connected to the forward membrane the membrane will move and thereby create the sound pressure which will be perceived as sound by a listener.

The membrane consists of two parts, a forward membrane part 4 and a rear membrane part 5. The membrane parts are connected, in this particular embodiment along the outer periphery of the membrane where the outer periphery is attached to the surround 8. Additionally the rear membrane part having a substantially V-shape whereby two free ends of the rear membrane 5 is created. The first end 12 as described above is connected to the forward membrane part 4 along the outermost periphery of the forward membrane part 4 whereby the forward membrane part 4 and the rear membrane part 5 are connected immediately adjacent their mutual connection to the surround 8. The second free end 13 of the rear membrane part 5 is connected adjacent connection point 4 point 4 between the forward membrane part and the coil cylinder 16, such that the V-shape of the rear membrane part 5 provides a high degree of stability for the membrane construction as discussed above.

By further arranging the spring member 15 behind the coil 2 and behind the movable mass a further degree of stability is imparted to the membrane construction whereby the movement of the membrane is controlled, but allows for the coils' relatively free movement back and forth in connection with spring member 15's movement. The stability, due to the relatively deep extent of the rear membrane part 5 in relation to the forward membrane part 4 creates a very stable forward membrane part whereby sound distortions and the like are greatly alleviated.

Figures 2, 3, 4, 5:
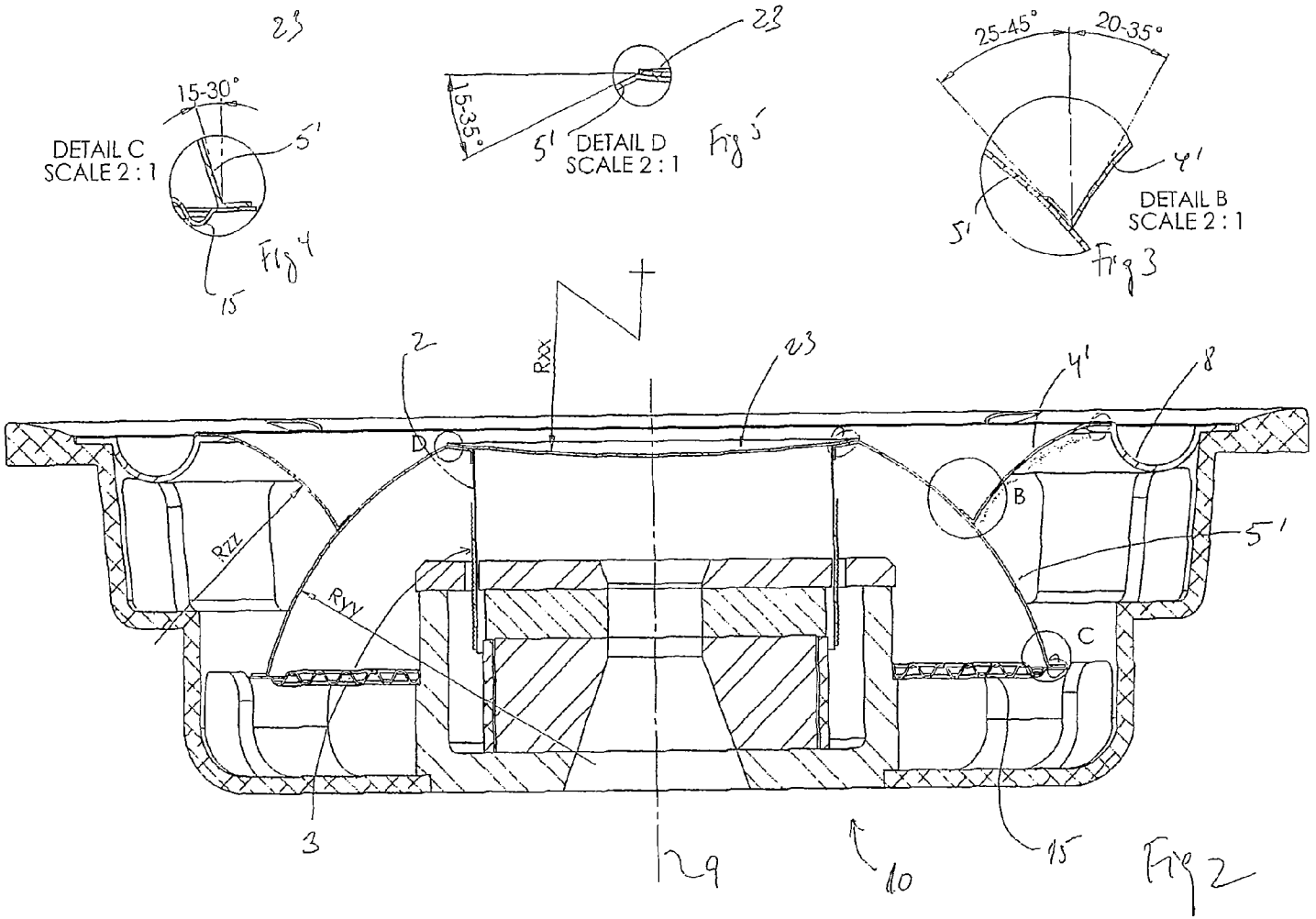
In FIG. 2 is illustrated a cross section through a second embodiment of a subwoofer according to the present invention.
FIGS. 3-5 illustrate connection details between the membrane parts and other parts of the subwoofer construction.

In FIG. 2 is illustrated a cross section through a second embodiment of the present invention. The features relating to the chassis driver unit voice coil or cylinder etc. as already explained above are exactly the same in this second embodiment where only the construction of the membrane itself differs from the embodiment already described above.

The forward part of the membrane 4' in this embodiment is attached along its outer periphery to a surround 8, for example by means of an adhesive connection. The inner edge of the surround is shaped to provide for a smooth transition from surround material to membrane material.

The opposite end of the harder part 4' of the membrane is connected to the rear membrane 5' in a central zone of the rear membrane 5'. The central zone shall be understood as a part of the rear membrane 5' in a central part of this such that the connection illustrated in FIG. 3 shall be made approximately centrally on the rear membrane 5'. The rear membrane is furthermore attached to the spring member 15 and a cover member 23. The cover member 23 serves to close off the cylinder 2 on which the voice coil 3 is arranged.

The membrane parts 4', 5' are furthermore arch-shaped whereby the resulting forces in the membranes are minimized such that the sound pressure in front of the subwoofer may be as high as possible without deforming the membrane.

In this context it has been found that the angles between the membrane parts 4', 5', the surround 8 and the cylinder 2 are very important.

Therefore, turning to FIGS. 3-5 the attachment details between the membrane parts 4', 5' and as in FIG. 3 the connection between the two membrane parts 4', 5' the spring 15 and the rear membrane part 5' and in FIG. 5 the cylinder tube and the rear membrane are illustrated. The angle spans illustrated are for illustrative purposes only but tests with membranes according to these principles have indicated very good results and the ability of the subwoofer to create very high sound pressures without or with insubstantial distortion of the produced sound.

The invention claimed is:

1. A flat subwoofer comprising:

a driver arranged on a chassis, the driver comprising an air gap;

a membrane comprising:

a forward membrane part; and a rear membrane part, wherein both membrane parts are substantially symmetrical around an axis perpendicular to a plane defined by the membrane parts, each membrane part comprising an outer periphery and an inner periphery, the outer periphery of forward membrane part connected to the chassis with a surround, the rear membrane part connected to a spring member, the spring member at least partly surrounding the driver behind the air gap, and the forward membrane part curved between the outer periphery and the inner periphery;

a coil arranged on a coil cylinder in the air gap, the coil cylinder connected to a connection between the forward membrane part and the rear membrane part;

wherein a cross section of the rear membrane part substantially forms a V shape, the V shape comprising a free end connected to the forward membrane part adjacent the inner periphery of the forward membrane part, a free end connected to the forward membrane part adjacent the outer periphery of the forward membrane part, and a bottom portion connected to the spring member, and the rear membrane part curved between the inner periphery and the bottom portion; and wherein at least one of the rear membrane part and the coil cylinder is provided with cut-outs.

2. The flat subwoofer of claim 1, wherein the chassis substantially encloses a rear side of the subwoofer and comprises least one of metal and plastic.

3. The flat subwoofer of claim 1, wherein a ventilation aperture is provided substantially central in the driver, the ventilation aperture connecting the interior of the subwoofer behind the forward membrane and the chassis.

* * * * *